US009097131B2

(12) United States Patent
Boyington

(10) Patent No.: US 9,097,131 B2
(45) Date of Patent: Aug. 4, 2015

(54) AIRFOIL AND DISK INTERFACE SYSTEM FOR GAS TURBINE ENGINES

(75) Inventor: Kimberly Pash Boyington, Haddam, CT (US)

(73) Assignee: United Technologies Corporation, Hartford, CT (US)

( * ) Notice: Subject to any disclaimer, the term of this patent is extended or adjusted under 35 U.S.C. 154(b) by 615 days.

(21) Appl. No.: 13/544,446

(22) Filed: Jul. 9, 2012

(65) Prior Publication Data

US 2013/0323064 A1 Dec. 5, 2013

Related U.S. Application Data

(63) Continuation-in-part of application No. 13/485,250, filed on May 31, 2012, now Pat. No. 8,905,716.

(51) Int. Cl.
*F01D 5/30* (2006.01)
*F01D 11/00* (2006.01)

(52) U.S. Cl.
CPC ..... *F01D 11/008* (2013.01); *F01D 5/3038* (2013.01); *Y10T 29/49321* (2015.01)

(58) Field of Classification Search
CPC ..... F01D 5/30; F01D 5/3038; F01D 5/3023; F01D 5/303; F01D 5/025; F01D 5/3046; F01D 11/05; F01D 11/006; F01D 11/008; F01D 11/00; F05D 2250/322; F05D 2240/90
USPC ..... 416/193 A, 218, 215, 248
See application file for complete search history.

(56) References Cited

U.S. PATENT DOCUMENTS

| | | | | |
|---|---|---|---|---|
| 2,717,554 | A | 9/1955 | Stalker | |
| 2,931,625 | A * | 4/1960 | Whited et al. | 416/215 |
| 3,972,645 | A * | 8/1976 | Kasprow | 416/215 |
| 4,464,096 | A * | 8/1984 | Trousdell et al. | 416/215 |
| 4,645,425 | A * | 2/1987 | Morrison, Jr. | 416/215 |
| 4,875,830 | A * | 10/1989 | Trousdell et al. | 416/215 |
| 4,878,811 | A | 11/1989 | Jorgensen | |
| 5,078,576 | A | 1/1992 | Hayton | |
| 5,431,542 | A | 7/1995 | Weisse et al. | |
| 5,924,699 | A | 7/1999 | Airey et al. | |
| 5,993,162 | A | 11/1999 | Weisse et al. | |
| 6,375,429 | B1 * | 4/2002 | Halila et al. | 416/193 A |
| 6,565,322 | B1 | 5/2003 | Lieser et al. | |
| 6,682,307 | B1 | 1/2004 | Tiemann | |
| 6,981,847 | B2 * | 1/2006 | Arinci et al. | 416/193 A |
| 7,080,974 | B2 | 7/2006 | Lejars et al. | |
| 7,284,959 | B2 | 10/2007 | Klingels et al. | |
| 7,306,433 | B2 | 12/2007 | Klingels et al. | |
| 7,334,331 | B2 * | 2/2008 | Bouchard et al. | 29/889.23 |
| 8,142,163 | B1 | 3/2012 | Davies | |
| 2004/0241001 | A1 * | 12/2004 | DiBella | 416/219 R |
| 2006/0222502 | A1 * | 10/2006 | Hansen et al. | 416/220 R |

* cited by examiner

*Primary Examiner* — Dwayne J White
*Assistant Examiner* — Joshua R Beebe
(74) *Attorney, Agent, or Firm* — Kinney & Lange, P.A.

(57) ABSTRACT

A gas turbine engine system includes a disk and an airfoil. The disk includes a first rail, a second rail, a retention slot located between the first and second rails, and a ridge extending radially outward from the second rail. The airfoil is engaged with the retention slot, and includes a platform with an upstream angled portion, a downstream angled portion, and a notch defined in the platform. The ridge of the disk extends at least partially into the notch of the platform.

18 Claims, 4 Drawing Sheets

AIRFOIL AND DISK INTERFACE SYSTEM FOR GAS TURBINE ENGINES

CROSS-REFERENCE TO RELATED APPLICATION(S)

This application is a continuation-in-part of application Ser. No. 13/485,250, filed on May 31, 2012 , which is hereby incorporated by reference in its entirety.

BACKGROUND

The present invention relates to seals and more particularly to seals for use with gas turbine engines.

Gas turbine engines include airfoils, such as blades and vanes, arranged in cascade configurations. These airfoils can be arranged in compressor or turbine sections of the engine. The airfoils can include a root (e.g., dovetail shaped root) that allows retention of the airfoil in a mounting structure, such as a rotor disk having one or more blade retention slots. For instance, a single circumferential rotor disk slot or a plurality of generally axial slots can be provided for airfoil retention. Many such airfoils include platforms that define a portion of an endwall or flowpath boundary adjacent to a working portion of the airfoil. In a cascade configuration, the platforms of adjacent airfoils adjoin one another at respective matefaces. However, gaps may remain between the matefaces of adjacent blades, and fluids can leak through those gaps. Fluid leakage can include the escape of fluid from a primary flowpath, leading to undesirable pressure loss. Ladder seals positioned between compressor rotor disks and blade platforms are known as a mechanism to provide mateface gap sealing. These ladder seals help reduce leakage of fluid between adjacent blade platforms, where gaps form. These seals are generally annular in configuration and resemble a "ladder" shape, with openings through which airfoil roots can pass.

It is desired to provide an improved ladder seal system.

SUMMARY

A gas turbine engine system includes a disk and an airfoil. The disk includes a first rail, a second rail, a retention slot located between the first and second rails, and a ridge extending radially outward from the second rail. The airfoil is engaged with the retention slot, and includes a platform with an upstream angled portion, a downstream angled portion, and a notch defined in the platform. The ridge of the disk extends at least partially into the notch of the platform.

Figure 1:
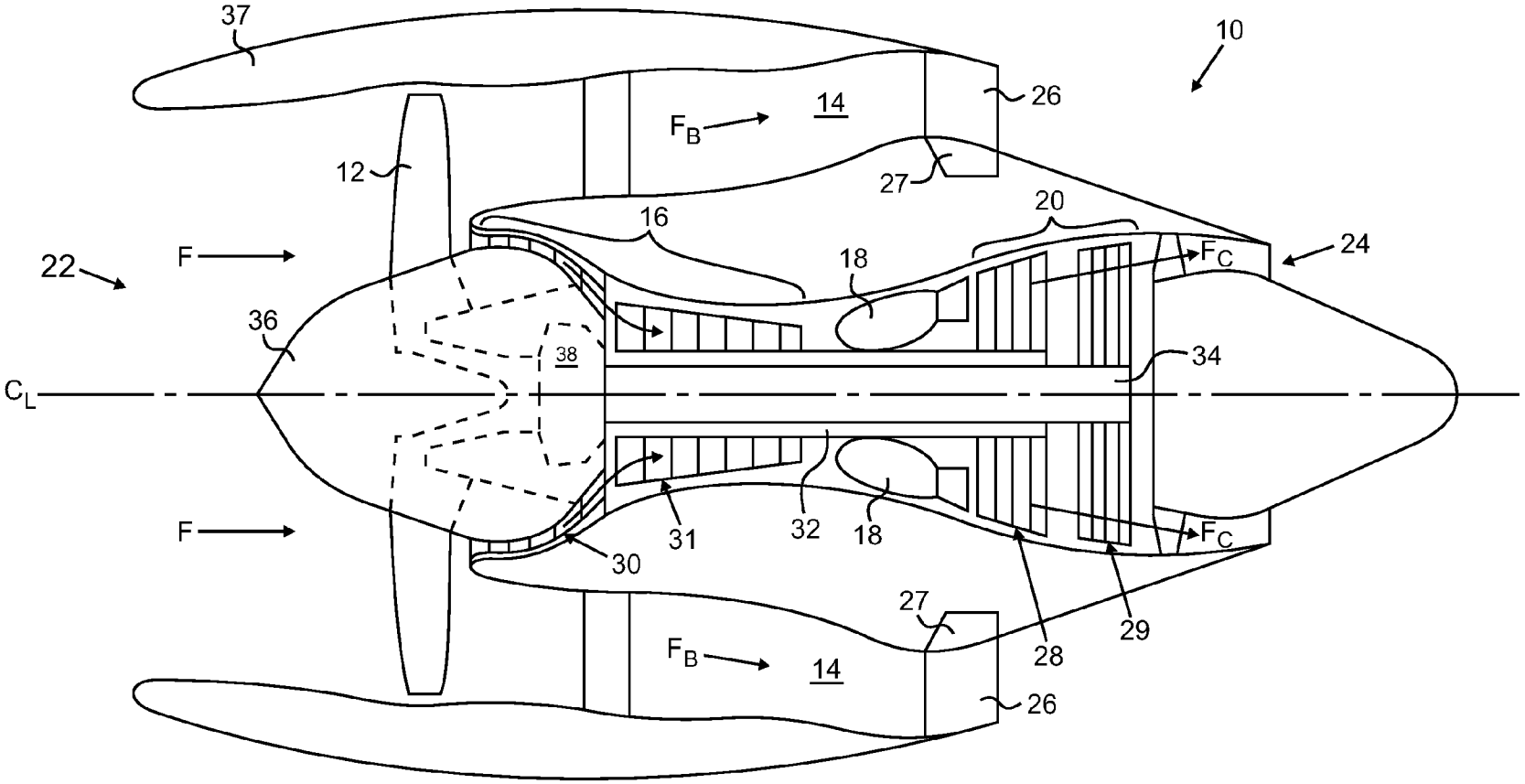
FIG. 1 is a schematic cross-sectional view of a gas turbine engine.

While the above-identified drawing figures set forth at least one embodiment of the invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features and components not specifically shown in the drawings.

DETAILED DESCRIPTION

In general, the present invention provides a ladder seal system suitable for use with airfoils (e.g., blades or stators) in a gas turbine engine. For example, the ladder seal can be used for a high pressure compressor stage with a mounting disk (e.g., rotor disk) having a circumferential airfoil retaining groove, and can be positioned between the disk and the platforms of airfoils engaged with the disk. The ladder seal can include angled flanges along opposite upstream (that is, leading or forward) and downstream (that is, trailing or aft) edges. In general, the specific angles and widths of the ladder seal flanges can be configured to correspond to an underside surface of blade platforms that are positioned adjacent to the ladder seal. At the upstream edge the ladder seal can have a wider flange than the flange at the downstream edge, or vice-versa. The flanges can be angled greater than 0° and less than 90° (e.g., approx. 15°) with respect to a tangential plane or a plane at a central circumferential portion of the ladder seal. The ladder seal can be configured to flex to accommodate tolerance variations and variations in alignment between adjacent blade platforms. Openings are provided in the ladder seal to allow insertion of airfoil roots. Openings in the ladder seal can include at least one double or barbell-shaped opening to accommodate a blade lock used to secure the airfoils to the disk.

FIG. 1 is a schematic cross-sectional view of an embodiment of a gas turbine engine 10. The illustrated embodiment of the engine 10 shows a turbofan configuration, though persons of ordinary skill in the art will appreciate that other configurations are possible in further embodiments. The gas turbine engine 10 includes a fan section 12, a bypass duct 14, a turbine core that includes a compressor section 16, a combustor section 18 and a turbine section 20, which are arranged between an upstream inlet 22 and a downstream exhaust outlet 24. An airflow F can enter the engine 10 via inlet 22 and can be divided into a bypass flow $F_B$ and a core flow $F_C$. The bypass flow $F_B$ can pass through the bypass duct 14, generating thrust, and the core flow $F_C$ passes along a primary flowpath through the compressor section 16, the combustor section 18 and the turbine section 20.

A variable area nozzle 26 can be positioned in bypass duct 14 in order to regulate a bypass flow $F_B$ with respect to a core flow $F_C$, in response to adjustment by one or more actuators 27. Adjustment of the variable area nozzle 26 allows the turbofan 10 to control or limit a temperature of the core flow $F_C$, including during times of peak thrust demand.

The turbine section 20 can include a high-pressure turbine (HPT) section 28 and a low-pressure turbine (LPT) section 29. The compressor section 16 can include a low pressure compressor (LPC) or boost section 30 and a high pressure compressor (HPC) section 31. The compressor 16 and turbine 20 sections can each include a number of stages of airfoils, which can be arranged as alternating cascades of rotating blades and non-rotating vanes (or stators). The HPT section 28 is coupled to the HPC 31 via a HPT shaft 32, forming a high pressure spool. The LPT section 29 is coupled to the fan section 12 and the LPC 30 via a LPT shaft 34, forming the low pressure or fan spool. The LPT shaft 34 can be coaxially mounted within HPT shaft 32, about centerline axis $C_L$, such that the HPT and LPT spools can rotate independently (i.e., at different speeds).

The fan section 12 is typically mounted to a fan disk or other rotating member, which is driven by the LPT shaft 34. A spinner 36 can be included covering the fan disk to improve aerodynamic performance. As shown in FIG. 1, for example, the fan section 12 is forward-mounted in an engine cowling 37, upstream of the bypass duct 14. In alternative embodiments, the fan section 12 can be aft-mounted in a downstream location, with an alternative coupling configuration. Further, while FIG. 1 illustrates a particular two-spool high-bypass turbofan embodiment of turbine engine 10, this example is provided merely by way of example and not limitation. In other embodiments, the gas turbine engine 10 can be configured either as a low-bypass turbofan or a high-bypass turbofan, in a reverse-flow configuration, the number of spools can vary, etc.

In the particular embodiment of FIG. 1, the fan section 12 is coupled to the LPT shaft 34 via an optional planetary gear or other fan drive geared mechanism 38 (shown in dashed lines), which provides independent speed control. More specifically, the fan drive gear mechanism 38 allows the engine 10 to control the rotational speed of the fan section 12 independently of the high and low spool speeds (that is, independently of HPT shaft 32 and LPT shaft 34), increasing the operational control range for improved engine response and efficiency across an operational envelope.

In operation, compressor 16 compresses incoming air of the core flow $F_C$ for the combustor section 18, where at least a portion of that air is mixed with fuel and ignited to produce hot combustion gas. The combustion gas can exit the combustor section 18 and enter the HPT section 28, which drives the HPT shaft 32 and in turn drives the HPC 31. Partially expanded combustion gas transitions from the HPT section 28 to the LPT section 29, driving the fan section 12 and the LPC 30 via the LPT shaft 34 and, in some embodiments, the fan drive gear mechanism 38. Exhaust gas can exit the engine 10 via exhaust outlet 24.

Figure 2A:
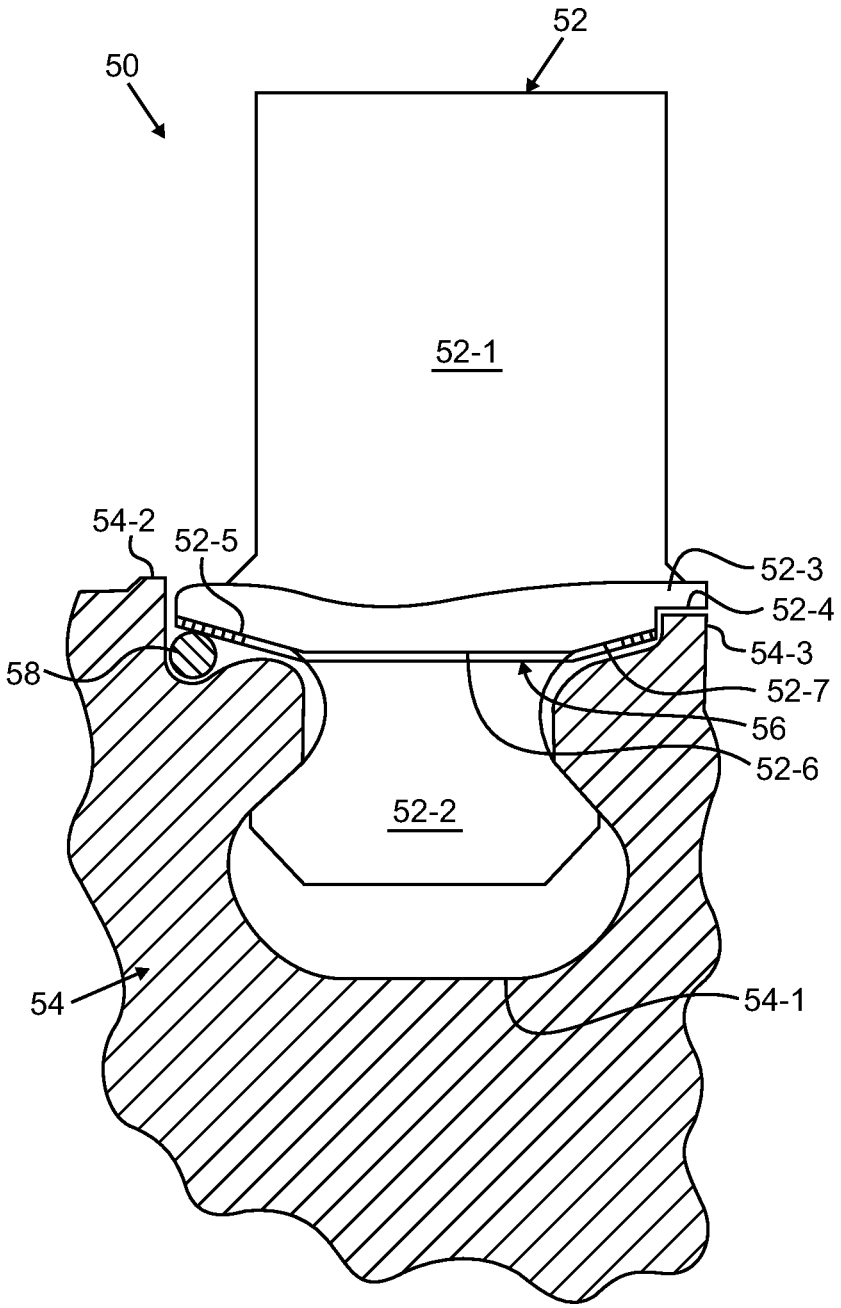
FIG. 2A is a cross-sectional view of a rotor disk assembly with a ladder seal system according to the present invention.
Figure 2B:
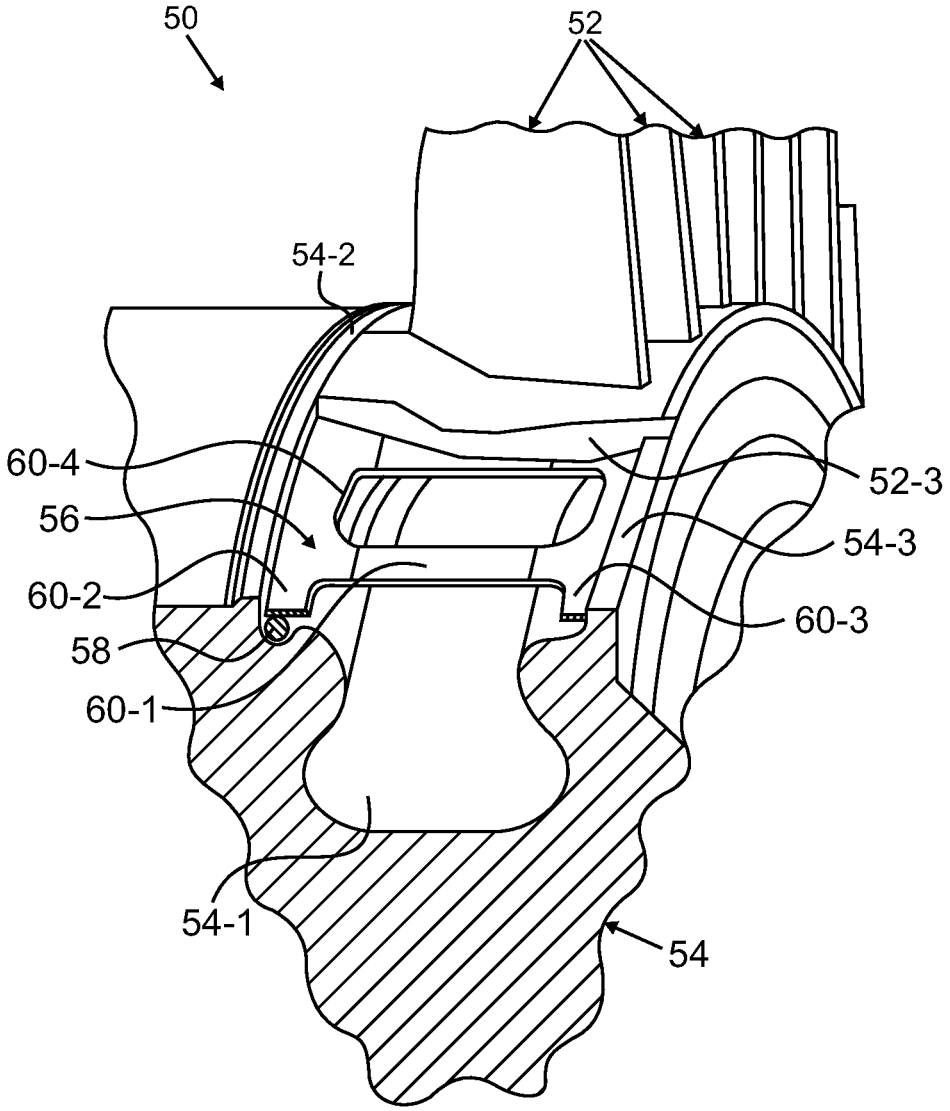
FIG. 2B is a cross-sectional perspective view of the rotor disk assembly with the ladder seal system.

FIGS. 2A and 2B are cross-sectional views of a rotor disk assembly 50 that includes airfoils 52 (e.g., rotor blades), a disk 54 (e.g., rotor disk), a ladder seal system 56, and an optional wire seal 58. The rotor disk assembly 50 can be a stage of the high pressure compressor 31, or can be in another section of the engine 10 in further embodiments. It should be noted that in FIG. 2B one airfoil 52 is omitted to better reveal otherwise hidden structures of the assembly 50.

As shown in the illustrated embodiment, each airfoil 52 can include a working portion 52-1, a root 52-2 and a platform 52-3 located between the working portion 52-1 and the root 52-2 (as used herein, the term "root" can also encompass what is sometimes separately referred to as a "shank"). The working portion 52-1 can be positioned to extend into a primary flowpath of the engine 10 to interact with a working fluid. The root 52-2 can have a dovetail shape or other desired shape to retain the airfoil 52 relative to the disk 54. The platform 52-3 can form a portion of a boundary of the primary flowpath. When positioned with other airfoils in a cascade, matefaces of adjacent platforms adjoin each other, with a small gap in between that runs in a generally upstream/downstream direction. Those of ordinary skill in the art will appreciate that airfoil platform matefaces can have a variety of configurations, from linear to non-linear, and can be arranged in an axial direction or at a non-parallel angle relative to the engine centerline $C_L$. The ladder seal system 56 can be utilized with nearly any type of mateface configuration.

At an underside (i.e., radially inner surface, as shown in the illustrated embodiment) of the platform 52-3, a notch 52-4, an upstream angled portion 52-5, a central portion 52-6, and a downstream angled portion 52-7 can be provided. The upstream angled portion 52-5 can angle away from the engine centerline $C_L$ in the forward direction, and the downstream angled portion 52-7 can angle away from the engine centerline $C_L$ in the downstream direction. Examples of possible angles of the portions 52-5 and 52-7 are discussed below. Thinning and angling the upstream and downstream portions 52-5 and 52-7 of the platform 52-3 outboard of the engine centerline $C_L$ can help provide tuning frequency margin for desirable structural tuning characteristics. Specific platform frequency modes can be tuned out, thereby reducing or eliminating failure modes present in prior art designs. Additional functions of various platform features are explained below.

The disk 54 includes at least one slot 54-1, which in the illustrated embodiment is a single circumferentially-extending slot at an outer rim of the disk 54. The slot 54-1 and the root 52-2 can have complementary shapes, allowing the slot 54-1 to radially retain the airfoil 52. A load feature (not shown) can be formed in the slot 54-1, or other suitable features provided, to facilitate insertion of the root 52-2 into the slot 54-1. Furthermore, a lock feature (not shown) can be provided in the slot 54-1 to allow engagement of an airfoil lock (not shown) to help secure a cascade of airfoils 52 in the slot 54-1.

The disk 54 can further include a ramped circumferential ridge 54-2 that extends radially outward from the outer rim on an upstream side of the slot 54-1 (i.e., on an upstream rail). The ridge 54-2 can protrude radially outward at least as far as a flowpath surface of the platform 52-3 of the airfoil 52, and be positioned upstream of a leading edge of the platform 52-3, in order to help reduce flow separation at or near the leading edge of the platform 52-3.

In addition, the disk 54 can further include a circumferentially-extending ridge 54-3 that extends radially outward from the outer rim on a downstream side of the slot 54-1 (i.e., on a downstream rail). The ridge 54-3 can be positioned generally upstream of a trailing edge of the platform 52-3 of the airfoil 52, that is, with a downstream edge of the ridge 54-3 located at or upstream of the trailing edge of the platform 52-3, such that the ridge 54-3 is positioned generally underneath the platform 54-3. The ridge 54-3 can extend circumferentially about the entire disk 54. In the illustrated embodiment, the ridge 54-3 has a generally rectangular cross-sectional shape, though other shapes are possible in further embodiments. Furthermore, in the illustrated embodiment, the ridge 54-3 is integrally and monolithically formed with a remainder of the disk 54. The notch 52-4 can be formed in the platform 52-3 immediately upstream of the trailing edge and immediately adjacent to the downstream angled portion 52-7, and can have a shape that is complementary to a shape of the ridge 54-3 of the disk 54, with the ridge 54-3 extending into (i.e., radially overlapping with) the notch 52-4. In the illustrated embodiment, the notch 52-4 has a substantially rectangular cross-sectional shape. The notch 52-4 can extend in a generally circumferential direction. A sealing effect is provided by the notch 52-4 and the ridge 54-3, which together alter the shape of a space between the platform 52-3 and the disk 54 by providing a tortuous leakage path and air dam. Furthermore, the ridge 54-3, in combination with the notch 52-4, can help robustly retain the ladder seal system 56 in the event of a ladder seal failure. Retention of the ladder seal system 56 during failure modes can help reduce or eliminate a risk of domestic object damage (DOD) caused by failed portions of the ladder seal system 56 escaping and contacting downstream parts of the engine 10. In alternative embodiments, the notch 52-4 and the ridge 54-3 could instead be located at or near a leading edge of the platform 52-3 and an upstream rail of the disk 54, respectively.

When relatively tight axial gapping tolerances are provided, the notch 52-4 and the ridge 54-3 can help provide assembly foolproofing. When only a single notch is provided on the platform 52-3 of the airfoils 52, the ridge 54-3 of the disk 54 can permit only a single orientation of the airfoil 52 when engaged with the retention slot 54-1, in order to help insure proper leading edge and trailing edge orientation of the airfoil 52. In this way, engagement of the root 52-2 of the airfoil 52 with the slot 54-1 in the disk 54 in an incorrect orientation can be prevented.

The ladder seal system 56 includes one or more arcuate ladder seal segments that extend circumferentially and are located at least partially within the space between the platform 52-3 of the airfoil 52 and the disk 54. In one embodiment, two approximately 180° segments are provided, though in further embodiments only one segment or more than two segments can be utilized.

Figure 3:
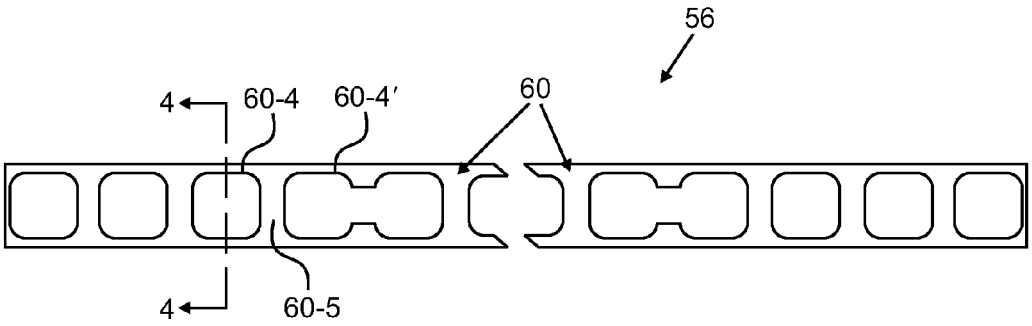
FIG. 3 is a top view of a ladder seal segment of the ladder seal system.
Figure 4:
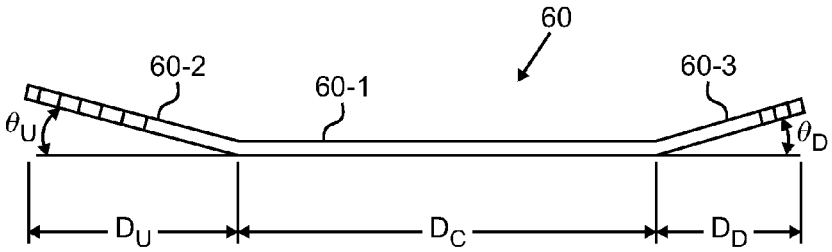
FIG. 4 is a cross-sectional view of the ladder seal segment, taken along line 4-4 of FIG. 3.

FIG. 3 is a top view of an embodiment of ladder seal segments 60 of the ladder seal system 56, and FIG. 4 is a cross-sectional view of one of the ladder seal segments 60, taken along line 4-4 of FIG. 3. The ladder seal segments 60 of the illustrated embodiment include a central portion 60-1, an upstream flange 60-2, a downstream flange 60-3, and a plurality of openings 60-4. The ladder seal segments 60 are asymmetric in the upstream/downstream or axial direction in the illustrated embodiment, though in alternative embodiments the segments 60 can be symmetric in the upstream/downstream or axial direction. The upstream flange 60-2 and the downstream flange 60-3 can be arranged to adjoin opposite sides of the central portion 60-1. In one embodiment, the ladder seal segments 60 can have a nominal thickness of approximately 0.254 mm (0.010 inch), or another thickness as desired.

The upstream flange 60-2 can be arranged at an angle $\theta_U$ greater than 0° and less than 90° relative to a given tangential plane 62 that is parallel to the centerline axis $C_L$. In one embodiment, the angle $\theta_U$ can be in the range of approximately 11.7° to 19.1°. In a further embodiment the angle $\theta_U$ can be approximately 15°. The upstream flange 60-2 can be configured to correspond to the upstream angled portion 52-5 of the platform 52-3, such that the upstream angled portion 52-5 is also arranged at the angle $\theta_U$. The downstream flange 60-3 can be arranged at an angle $\theta_D$ greater than 0° and less than 90° relative to the given tangential plane 62. In one embodiment, the angle $\theta_D$ can be in the range of approximately 11.3° to 18.5°. In a further embodiment the angle $\theta_D$ can be approximately 15°. The downstream flange 60-3 can be configured to correspond to the downstream angled portion 52-7 of the platform 52-3, such that the downstream angled portion 52-7 is also arranged at the angle $\theta_D$. The angles $\theta_U$ and $\theta_D$ can be selected such that the flanges 60-2 and 60-3 are angled radially outward, that is, toward the platforms 52-3 of the airfoils 52, when installed. The central portion 60-1 can have a substantially planar configuration and be arranged tangentially relative to the centerline axis $C_L$. In general, the shape of the segments 60 can correspond to a shape of the underside of the platform 52-3, with the upstream flange 60-2 corresponding to the upstream angled portion 52-5, the central portion 60-1 corresponding to the central portion 52-6, and the downstream portion 60-3 corresponding to the downstream angled portion 52-7. It should be noted that the particular angles and ranges of angles described above are provided merely by way of example and not limitation. Other angles and angle ranges are possible in further embodiments.

The upstream flange 60-2 can have a width $D_U$ in a direction parallel to the centerline axis $C_L$ (i.e., a projected width along the centerline axis $C_L$), the central portion 60-1 can have a width $D_C$ in the same direction (i.e., a projected width along the centerline axis $C_L$), and the downstream flange 60-3 can have a width $D_D$ in the same direction (i.e., a projected width along the centerline axis $C_L$). In some embodiments, the width $D_U$ can be different (e.g., greater than) the width $D_D$. For example, in one embodiment, the width $D_U$ can be in a range of approximately 0.312 to 0.389 cm (0.123 to 0.153 inches) and the width $D_D$ can be in a range of approximately 0.231 to 0.257 cm (0.091 to 0.101 inches). Dimensions of the seal segments 60 can be selected such that an upstream edge of each segment 60 terminates at or downstream of the leading edge of the platforms 52-3, and such that a trailing edge of each segment 60 terminates at or upstream of the notch 52-4. It should be noted that other dimensions are possible in further embodiments.

The openings 60-4 are provided to allow the roots 52-2 of the airfoils 52 to pass through the ladder seal segment 60. The number and size of the openings 60-4 can vary as desired for particular applications, and can vary as function of a size of the roots 52-2. The openings 60-4 are spaced apart such that body portions of the seal segments 60 generally form a "ladder" shape. The body portions of the segments 60 can rest against the underside surfaces of the platforms 52-3 of the airfoils 52, with portions 60-5 of the seal segments 60 in between adjacent openings 60-4 covering and sealing gaps between adjacent platform matefaces. In the illustrate embodiment, the openings 60-4 extend through the central portion 60-1 as well as portions of the upstream and downstream flanges 60-2 and 60-3. Circumferential ends of the segments 60 can terminate within the openings 60-4, to help avoid interruption of the portions 60-5 that provide sealing.

One or more barbell-shaped openings 60-4' can optionally be provided in the seal segments 60. The openings 60-4' can be formed in a shape resembling two adjacent openings 60-4 with a connection channel that forms a common opening space. The openings 60-4 can accommodate two roots 52-2 and a lock engaged with the slot 54-1 of the disk 54 that helps retain the airfoils 52.

The seal segments 60 can be made of a metallic material, and can be flexible to accommodate positional variations between platforms 52-3 of adjacent airfoils 52 that occur during operation or are the result of small manufacturing tolerance variations. Furthermore, the flanges 60-2 and 60-3 can flex relative to the central portion 60-1 of the seal segments 60 such that the seal segments can fit closely against the undersides of the platforms 52-3 to provide relatively good sealing.

If the optional wire seal 58 is provided, the wire seal 58 can abut an underside (i.e., radially inner surface) of the ladder seal segments 60.

Any relative terms or terms of degree used herein, such as "substantially", "essentially", "generally" and the like, should be interpreted in accordance with and subject to any applicable definitions or limits expressly stated herein. In all instances, any relative terms or terms of degree used herein should be interpreted to broadly encompass any relevant disclosed embodiments as well as such ranges or variations as would be understood by a person of ordinary skill in the art in view of the entirety of the present disclosure, such as to encompass ordinary manufacturing tolerance variations, incidental alignment variations, alignment or shape variations induced by thermal or rotational operational conditions, and the like.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims. For example, while described primarily with respect to an embodiment for a rotor assembly of a gas turbine engine compressor, the ladder sealing system of the present invention can also be utilized for stator assemblies and/or for turbine sections.

Discussion of Possible Embodiments

The following are non-exclusive descriptions of possible embodiments of the present invention.

A gas turbine engine system can include a disk having a first rail, a second rail, a retention slot located between the first and second rails, and a ridge extending radially outward from the second rail; and an airfoil engaged with the retention slot, the airfoil having a platform with an upstream angled portion, a downstream angled portion, and a notch defined in the platform, wherein the ridge of the disk extends at least partially into the notch of the platform.

The system of the preceding paragraph can optionally include, additionally and/or alternatively, any one or more of the following features, configurations and/or additional components:

wherein the upstream angled portion can be arranged at an angle $\theta_U$ that is acute relative to a tangential direction, wherein the downstream angled portion can be arranged at an angle $\theta_D$ that is acute relative to a tangential direction, and wherein both the upstream and downstream angled portions angle radially outward toward an adjacent edge;

the angle $\theta_U$ can be in a range of approximately 11.7° to 19.1°, and wherein the angle $\theta_D$ can be in the range of approximately 11.3° to 18.5°;

the angle $\theta_U$ can be approximately 15°;

the angle $\theta_D$ is approximately 15°;

the first rail can be located upstream of the second rail, and wherein the retention slot comprises a circumferential slot;

a ladder seal system positioned at least partially between the platform of the airfoil and the disk;

the ladder seal system can comprise a plurality of arcuate ladder seal segments;

the ridge extends circumferentially;

the ridge can extend circumferentially about the entire disk.

the notch can extend circumferentially and is located at or near a trailing edge of the platform;

the ridge can have a substantially rectangular cross-sectional shape;

the notch can have a generally rectangular cross-sectional shape complementary to the substantially rectangular cross-sectional shape of the ridge;

the notch can have a shape that is complementary to a shape of the ridge; and/or the ridge can be integrally and monolithically formed with the disk.

A method for making a gas turbine engine system can include defining a circumferentially-extending notch in an airfoil platform; engaging the airfoil with a slot in a disk; and positioning a circumferentially extending ridge at least partially within the notch in the radial direction.

The method of the preceding paragraph can optionally include, additionally and/or alternatively, any one or more of the following features and/or additional steps:

preventing engagement of the airfoil with the slot in the disk in an incorrect orientation; and/or providing a ladder seal segment; angling an upstream flange of the seal segment at an angle $\theta_U$ greater than 0° and less than 90° relative to a given tangential plane; angling a downstream flange of the seal segment at an angle $\theta_D$ greater than 0° and less than 90° relative to the given tangential plane; forming an opening in the seal segment, wherein the opening extends through at least portions of both the upstream and downstream flanges; and positioning the ladder seal segment between the airfoil platform and the disk.

A gas turbine engine system can include a rotor disk having an upstream rail, a downstream rail, a circumferential retention slot located between the upstream and downstream rails, and a circumferential ridge extending radially outward from the downstream rail; and an airfoil engaged with the circumferential retention slot, the airfoil having a platform and a notch defined in the platform, wherein the circumferential ridge of the rotor disk extends at least partially into the notch, and wherein both the upstream and downstream angled portions angle radially outward toward an adjacent edge.

the platform can further define an upstream angled portion and a downstream angled portion, wherein the upstream angled portion is arranged at an angle $\theta_U$ in a range of approximately 11.7° to 19.1°, and wherein the downstream angled portion is arranged at an angle $\theta_D$ in a range of approximately 11.3° to 18.5°;

the ridge can have a substantially rectangular cross-sectional shape, and wherein the notch has a generally rectangular cross-sectional shape complementary to the substantially rectangular cross-sectional shape of the ridge.

an arcuate first ladder seal segment positioned between the rotor disk and the platform of the airfoil, the first ladder seal segment including: a central portion; an upstream flange adjoining the central portion, wherein the upstream flange has a width $D_U$ and is arranged at an angle that complements an angle of an upstream portion of the platform of the airfoil; and a downstream flange adjoining the central portion opposite the upstream flange, wherein the downstream flange has a width $D_D$ and is arranged at an angle that complements an angle of a downstream portion of the platform of the airfoil, and wherein the width $D_U$ is not equal to the width $D_D$.

The invention claimed is:

1. A gas turbine engine system comprising:

a disk having a first rail, a second rail, a retention slot located between the first and second rails, and a ridge extending radially outward from the second rail;

an airfoil engaged with the retention slot, the airfoil having a platform with an upstream angled portion, a downstream angled portion, and a notch defined in the platform, wherein the ridge of the disk extends at least partially into the notch of the platform;

a ladder seal system position at least partially between the platform of the airfoil and the disk, wherein the ladder seal system comprises a plurality of arcuate ladder seal segments; and the ladder seal is arranged to conform to the platform angled portions, in an uninstalled state.

2. The system of claim 1, wherein the upstream angled portion is arranged at an angle $\theta_U$ that is acute relative to a tangential direction, wherein the downstream angled portion is arranged at an angle $\theta_D$ that is acute relative to a tangential direction, and wherein both the upstream and downstream angled portions angle radially outward toward an adjacent edge.

3. The system of claim 2, wherein the angle $\theta_U$ is in a range of approximately 11.7° to 19.1°, and wherein the angle $\theta_D$ is in the range of approximately 11.3° to 18.5°.

4. The system of claim 2, wherein the angle $\theta_U$ is approximately 15°.

5. The system of claim 2, wherein the angle $\theta_D$ is approximately 15°.

6. The system of claim 1, wherein the first rail is located upstream of the second rail, and wherein the retention slot comprises a circumferential slot.

7. The system of claim 1, wherein the ridge extends circumferentially.

8. The system of claim 7, wherein the ridge extends circumferentially about the entire disk.

9. The system of claim 7, wherein the notch extends circumferentially and is located at or near a trailing edge of the platform.

10. The system of claim 1, wherein the ridge has a substantially rectangular cross-sectional shape.

11. The system of claim 10, wherein the notch has a generally rectangular cross-sectional shape complementary to the substantially rectangular cross-sectional shape of the ridge.

12. The system of claim 1, wherein the notch has a shape that is complementary to a shape of the ridge.

13. The system of claim 1, wherein the ridge is integrally and monolithically formed with the disk.

14. A method for making a gas turbine engine system, the method comprising:

defining a circumferentially-extending notch in an airfoil platform;

said platform having an upstream angled portion and a downstream angled portion defined in the platform;

engaging the airfoil with a slot in a disk;

positioning a circumferentially extending ridge at least partially within the notch in the radial direction;

preventing engagement of the airfoil with the slot in the disk in an incorrect orientation;

positioning an arcuate ladder seal segment partially between the platform of the airfoil and the disk; and said aruate ladder seal segment angle to conform to the platform in an uninstalled state.

15. A gas turbine engine system comprising:

a rotor disk having an upstream rail, a downstream rail, a circumferential retention slot located between the upstream and downstream rails, and a circumferential ridge extending radially outward from the downstream rail;

an airfoil engaged with the circumferential retention slot, the airfoil having a platform with an upstream angled portion, a downstream angled portion and a notch defined in the platform, wherein the circumferential ridge of the rotor disk extends at least partially into the notch, and wherein both the upstream and downstream angled portions angle radially outward toward an adjacent edge; and an arcuate ladder seal segment positioned between the rotor disk and the platform of the airfoil, the ladder seal segment angled to conform to the platform in an uninstalled state.

16. The system of claim 15, wherein the upstream angled portion is arranged at an angle $\theta_U$ in a range of approximately 11.7° to 19.1°, and wherein the downstream angled portion is arranged at an angle $\theta_D$ in a range of approximately 11.3° to 18.5°.

17. The system of claim 15, wherein the ridge has a substantially rectangular cross-sectional shape, and wherein the notch has a generally rectangular cross-sectional shape complementary to the substantially rectangular cross-sectional shape of the ridge.

18. The system of claim 15 and further comprising:

said arcuate first ladder seal segment including:

a central portion;

an upstream flange adjoining the central portion, wherein the upstream flange has a width $D_U$ and is arranged at an angle that complement an angle of an upstream portion of the platform of the airfoil; and a downstream flange adjoining the central portion opposite the upstream flange, wherein the downstream flange has a width $D_D$ and is arranged at an angle that complement an angle of a downstream portion of the platform of the airfoil, and wherein the width $D_U$ is not equal to the width $D_D$.

* * * * *

UNITED STATES PATENT AND TRADEMARK OFFICE

CERTIFICATE OF CORRECTION

PATENT NO. : 9,097,131 B2
APPLICATION NO. : 13/544446
DATED : August 4, 2015
INVENTOR(S) : Kimberly Pash Boyington It is certified that error appears in the above-identified patent and that said Letters Patent is hereby corrected as shown below:

In the claims

Col. 8, Line 66
Delete "position"
Insert --positioned--

Col. 10, Line 1
Delete "aruate"
Insert --arcuate--

Col. 10, Line 1
Delete "angle"
Insert --angled--

Col. 10, Line 35
Delete "complement"
Insert --complements--

Col. 10, Line 40
Delete "complement"
Insert --complements--

Signed and Sealed this
Twenty-second Day of December, 2015

Michelle K. Lee

Michelle K. Lee
*Director of the United States Patent and Trademark Office*